US012275571B2

(12) United States Patent
Watson et al.

(10) Patent No.: US 12,275,571 B2
(45) Date of Patent: Apr. 15, 2025

(54) PACKAGE CONFIGURED TO HOLD PRODUCTS AND HAVING ACTIVE MEMBER ATTACHED TO AN INTERIOR SURFACE THEREOF, AND METHOD OF MAKING SAME

(71) Applicant: CSP Technologies, Inc., Auburn, AL (US)

(72) Inventors: Neal D. Watson, Marietta, GA (US); Michael A. Johnston, Atlanta, GA (US); Terrence Green, Atlanta, GA (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 72 days.

(21) Appl. No.: 17/933,749

(22) Filed: Sep. 20, 2022

(65) Prior Publication Data

US 2023/0020791 A1 Jan. 19, 2023

Related U.S. Application Data

(63) Continuation of application No. PCT/US2021/070347, filed on Apr. 1, 2021.

(Continued)

(51) Int. Cl.
*B65D 81/26* (2006.01)
*B65B 9/06* (2012.01)

(Continued)

(52) U.S. Cl.
CPC ..... *B65D 81/264* (2013.01); *B65B 9/06* (2013.01); *B65B 25/001* (2013.01); *B65B 55/00* (2013.01);

(Continued)

(58) Field of Classification Search
CPC .. B65D 81/264; B65D 81/267; B65D 75/008; B65B 25/001; B65B 61/20
See application file for complete search history.

(56) References Cited

U.S. PATENT DOCUMENTS 4,815,590 A * 3/1989 Peppiatt ..... B65D 81/264 206/204
4,956,962 A * 9/1990 Williams ..... B65D 75/5855 53/433

(Continued)

FOREIGN PATENT DOCUMENTS

GB 989831 A 4/1965
JP 2023014614 A 1/2023

(Continued)

OTHER PUBLICATIONS

International Search Report issued in PCT/US2021/070347, mailed Jul. 23, 2021.

(Continued)

*Primary Examiner* — Andrew M Tecco
(74) *Attorney, Agent, or Firm* — Mark T. Vogelbacker; Eckert Seamans Cherin & Mellott, LLC

(57) ABSTRACT

A package for containing liquid-exuding product is formed of a single sheet of film that is folded and sealed at certain locations. The package can include an active member, optionally in the form of absorbent, that is heat staked or otherwise attached to a portion of the sheet of film such that the active member is located on an interior surface of a bottom of the folded and sealed package.

3 Claims, 7 Drawing Sheets

Related U.S. Application Data

(60) Provisional application No. 63/200,236, filed on Feb. 23, 2021, provisional application No. 63/004,295, filed on Apr. 2, 2020.

(51) Int. Cl.

| | |
|---|---|
| ***B65B 25/00*** | (2006.01) |
| ***B65B 55/00*** | (2006.01) |
| ***B65D 75/00*** | (2006.01) |
| ***B65D 75/20*** | (2006.01) |

(52) U.S. Cl.

CPC ..... *B65D 75/008* (2013.01); *B65D 75/20* (2013.01); *B65D 81/267* (2013.01); *B65D 2575/3209* (2013.01); *B65D 2575/54* (2013.01)

(56) References Cited

U.S. PATENT DOCUMENTS

| | | | | |
|---|---|---|---|---|
| 5,660,868 | A * | 8/1997 | Yeager | B65D 81/264 426/112 |
| 5,820,955 | A * | 10/1998 | Brander | B65D 81/264 428/36.1 |
| 5,826,401 | A * | 10/1998 | Bois | B65B 41/16 53/139.2 |
| 6,089,367 | A * | 7/2000 | Anderson | B65D 81/264 206/204 |
| 6,376,034 | B1 * | 4/2002 | Brander | B65D 81/264 524/48 |
| 7,141,770 | B2 * | 11/2006 | Zafiroglu | B65D 81/3461 426/109 |
| 8,800,250 | B2 * | 8/2014 | Moehlenbrock | B65B 43/42 493/212 |
| 2004/0161174 | A1 | 8/2004 | Bartel et al. | |
| 2004/0163973 | A1 | 8/2004 | Longo | |
| 2011/0281486 | A1 * | 11/2011 | Baciu | B32B 5/024 442/283 |
| 2016/0016718 | A1 * | 1/2016 | Berbert | B65D 81/3461 428/350 |
| 2016/0101916 | A1 | 4/2016 | Grijalva Varillas | |
| 2016/0311603 | A1 * | 10/2016 | Monforton | A23L 7/161 |
| 2024/0002119 | A1 | 1/2024 | Belias et al. | |

FOREIGN PATENT DOCUMENTS

| | | | |
|---|---|---|---|
| WO | 03004266 | A1 | 1/2003 |
| WO | 2011067305 | A1 | 6/2011 |

OTHER PUBLICATIONS

Written Opinion issued in PCT/US2021/070347, mailed Jul. 23, 2021.

* cited by examiner

PACKAGE CONFIGURED TO HOLD PRODUCTS AND HAVING ACTIVE MEMBER ATTACHED TO AN INTERIOR SURFACE THEREOF, AND METHOD OF MAKING SAME

CROSS-REFERENCE TO RELATED APPLICATIONS

The present application is a continuation of PCT International Application No. PCT/US2021/070347, filed Apr. 1, 2021, which claims priority to U.S. Provisional Application No. 63/200,236, filed Feb. 23, 2021 and U.S. Provisional Application No. 63/004,295, filed Apr. 2, 2020, the entire disclosure of each is hereby incorporated by reference in their entirety.

FIELD

The presently disclosed technology relates generally to packages for containing product, such as, but not limited to, liquid-exuding product, foodstuff, and/or other (e.g., perishable) product. In one optional embodiment, the presently disclosed technology relates to a stand-up pouch having an absorbent layer attached to or integrally formed with or onto an inside of the pouch, such as at a bottom of the pouch.

BACKGROUND AND DESCRIPTION OF RELATED ART

Stand-up pouches are known to hold a variety of items, such as soap, certain foodstuff (e.g., pretzels), or items that may include purge (also known as "liquid-exuding product"), such as, but not limited to, fresh cut fruit, frozen or fresh seafood or poultry products.

These prior art pouches can be produced or formed from a single piece of film, which is folded and sealed upon itself, such as described in U.S. Patent Application Publication No. 2004/0161174, which is hereby incorporated by reference. One current manufacturer of such pouches is AQUA STAR® of Seattle, Washington. Alternatively, these prior art pouches can be produced by attaching two or more pieces of film, for example where during manufacturing a bottom piece or sheet is moved transversely into a path of one or more other pieces or sheets, and then the various pieces or sheets are attached.

Conventional pouches are produced without an absorbent integrated into or otherwise attached to the pouch. Instead, in instances of holding liquid-exuding product in prior art pouches, one or more absorbent pads are added or inserted to the interior of the completed pouch (loosely) after the pouch is formed and at the time or shortly before the pouch is filled with product. Such conventional pads are not fixed to the pouch, but can move inside the pouch.

The addition of an absorbent pad to prior art pouches can be relatively expensive, and is an extra step required during assembly or filling of the pouch. Further, the absorbent may not stay positioned in the desired location within the pouch, and has the potential to be useless or at least less effective if it moves (e.g., away from the bottom or if the pouch is titled) during transport or while being stocked on a shelf. In addition, such loose pads can undesirably mix in or be mistaken form other contents (e.g., foodstuff) of the pouch.

BRIEF SUMMARY

Despite the numerous benefits of the above and other prior art teachings, it would be desirable for a stand-up pouch to include an active member (e.g., including an absorbent, a releasing agent, an antimicrobial agent, a desiccant, an oxygen scavenger, and/or the like) fixed or adhered to the film of the pouch before the film is folded, sealed, and/or created into the final shape of the pouch. Users of conventional pouches with separate absorbent often complain that when the product is transported or thawed, for example, the purge is not adequately or fully absorbed because the absorbent is not maintained in the desired location (e.g., the bottom of the pouch). This can result in undesirable degradation of the product, resulting in the product being unfit or at least less than ideal for consumption or use.

The presently disclosed technology makes-up for the above and other drawbacks of the prior art, and accomplishes the above and other goals. In particular, in one aspect, the presently disclosed technology ensures that the active member (e.g., an absorbent) will always be located in a predetermined location (e.g., at the bottom of the pouch) and will substantially or entirely absorb the free liquid of the contents of the product. In addition, the individual or entity filling the pouch with product will not have to add a separate absorbent, for example, during the packaging of the product.

In one aspect, the presently disclosed technology is directed to a single-use, stand-up pouch formed of one or more sheets of film that are folded, sealed, and/or attached into a final shape of a pouch. The pouch optionally includes an active member attached, fixed, and/or formed integrally with or onto an interior surface of a bottom of the pouch. Optionally, the active member is thermally bonded, e.g., heat staked, thermoplastic staked, welded, or otherwise fixed or adhered (e.g., glued) to the interior surface of the bottom of the pouch.

Optionally, one method according to the presently disclosed technology includes heat staking an absorbent to a flat sheet of film and then folding the sheet of film into the shape of a pouch, such that the absorbent is located on an interior surface of a bottom of the pouch.

BRIEF DESCRIPTION OF THE DRAWINGS

The foregoing summary, as well as the following detailed description of the presently disclosed technology, will be better understood when read in conjunction with the appended drawings, wherein like numerals designate like elements throughout. For the purpose of illustrating the presently disclosed technology, there are shown in the drawings various illustrative embodiments. It should be understood, however, that the presently disclosed technology is not limited to the precise arrangements and instrumentalities shown. In the drawings.

DETAILED DESCRIPTION

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

The term "liquid-exuding product" is broadly defined herein to include any product or products (e.g., foodstuff) from which moisture or liquid (e.g., oil and/or water) can (a) be emitted (such as meats, fish, poultry, fruits, vegetables and the like), and/or (b) form on, adhere to, and/or release from depending upon the particular environment or atmosphere (e.g., due to the dew point temperature).

Thermoplastic staking (sometimes referred to herein as "thermoforming" or "thermostaking") or heat staking is a process that uses heat to deform a plastic boss. In one optional embodiment, a plastic stud protruding from one component fits into a hole in the second component. The stud can then be deformed through the softening of the plastic to form a head, which can mechanically lock the two components together. Heat staking is a versatile technique that is quick, economical and consistent. Staking has the ability to join plastics to other materials (e.g. metal, PCB's) in addition to joining like or dissimilar plastics.

Optionally, a package of the presently disclosed technology can be in the form of a pouch, such as a stand-up pouch or a pouch without a defined shape. An active member (e.g., an absorbent) can be provided on, optionally fixedly attached to, or integrally formed with or onto at least a portion (e.g., an interior surface of a bottom) of the package.

In one embodiment, the presently disclosed technology is directed to a process or method to ensure that the liquid exuding from a product within the package is absorbed by an absorbent within the package.

Figure 1:
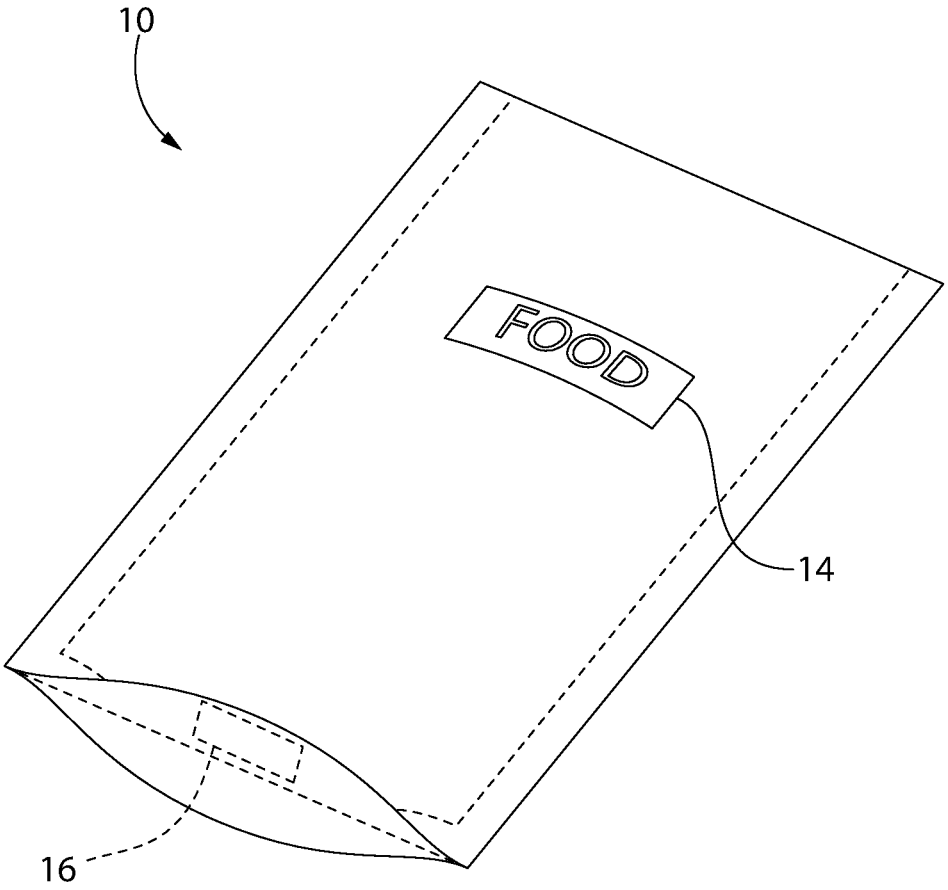
FIG. 1 is a perspective view of a package according to one optional embodiment of the presently disclosed technology.
Figure 2:
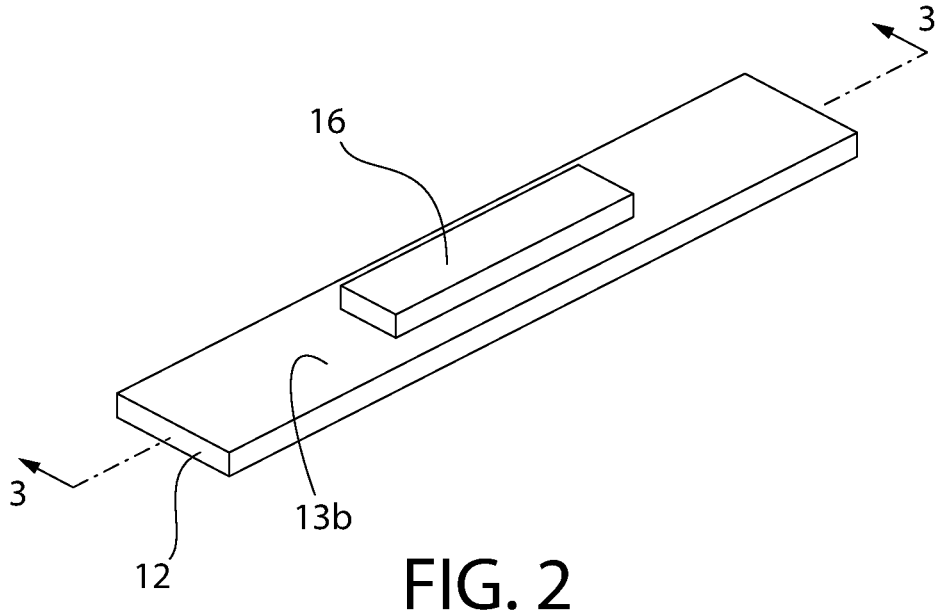
FIG. 2 is a schematic perspective view of at least a portion of a sheet of film, which can be folded, sealed, and/or added to one or more other pieces or sheets of film to form the package of FIG. 1, and an active member according to one optional embodiment of the presently disclosed technology.
Figure 3:
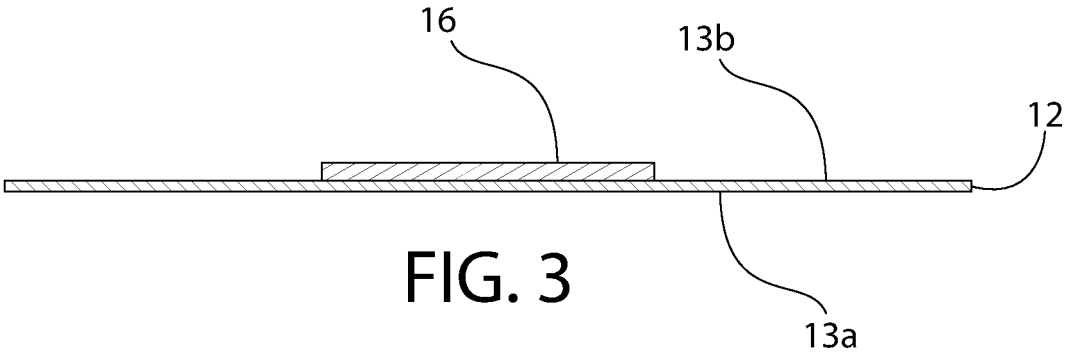
FIG. 3 is a magnified cross-sectional elevation view of at least a portion of the film and active member shown in FIG. 2, where the portion of the package is shown in an unfolded and/or unsealed form, and where the cross-section is taken along line 3-3 of FIG. 2

Referring now in detail to the various figures of the drawings wherein like reference numerals refer to like parts throughout, FIG. 1 shows a package, generally designated 10, which can be used according to an aspect of the disclosed concept. Optionally, as shown in FIGS. 2 and 3, the package 10 can be formed by or from a single sheet of film 12, or two or more separate pieces of the film 12. One side 13*a* (e.g., bottom and/or exterior side) of the film 12 can optionally include indicia or advertisement(s) 14 (e.g., such as in the form of a separate label or writing directly on the film 12). A second or opposing side 13*b* (e.g., top and/or interior side) of the film 12 can optionally be devoid of any indicia or advertisement.

Optionally, the film 12 can be rolled, folded, manipulated, cut, and/or at least partially or completely sealed to form a pouch. Optionally, the package 10 can be formed from two or more distinct pieces of film 12, which can be attached or adhered at distinct forms to create the desired shape of the pouch. The film 12 is not limited to a particular type or style, and can be clear, transparent, translucent, opaque, or the like. The final form of the package 10 can be a stand-up pouch (e.g., in which the pouch can stand-up under its own strength with the bottom thereof facing the support surface), such as shown in FIG. 1, or the package 10 can have an undefined shape (e.g., a frozen bag of corn or peas).

Prior to forming or folding the package 10, an active member 16 can be attached to the opposing side 13*b* of the film. Optionally, when the pouch is formed and ready to receive product (e.g., liquid-exuding product), the active member 16 is located at or proximate to a bottom of the pouch (e.g., opposite the opening to a cavity formed by the pouch). The active member 16 can be attached to the film 12 by heat staking, for example, or by other means, such as thermoforming, adhesive, one or more fasteners, and/or the like.

In any optional embodiment, the active member 16 can be an absorbent. However, the present disclosure is not so limited. For example, the active member 16 can be an entrained material or polymer includes a base material (e.g., polymer) for providing structure, optionally a channeling agent, and an active agent. However, other variations of an active member are possible. For example, an active member can also consist of a base material and an active agent, without a channeling agent. The channeling agent ca form microscopic interconnecting channels through the entrained polymer. In other embodiments, the active member 16 can be or include a releasing agent, an antimicrobial agent, a desiccant, an oxygen scavenger, and/or the like.

Optionally, the active member 16 can be in the form of or include a pad. In one optional embodiment, a porous material that can include, house, or at least partially surround the absorbent material (e.g., powder), or can retain the absorbent material in or more reservoirs in the porous material. In one optional embodiment, the pad can include a nonwoven.

Optionally, the pad can be attached to the sheet of film 12 by placing a heating element above the pad (e.g., nonwoven). The nonwoven can optionally include a sheath core of polypropylene (PP)-polyethylene (PE) composition. In operation, the PE melts and sticks to the film beneath the pad. In another optional embodiment, the pad with absorbent material (e.g., powder) in it can be heat staked to the sheet of film. Alternatively, during formation of the package 10, a dispenser could dispense loose granules of absorbent onto the film 12 and then a nonwoven can be heat staked on top of the loose granules, thereby holding the loose granules in place with respect to a portion of the film 12.

In one embodiment, the nonwoven includes or is composed of polyethylene terephthalates and polyethylene in a sheath and core configuration, thereby allowing the nonwoven to be heat sealed to the film. Optionally, the nonwoven can have a density of approximately 20 g/m$^2$, or in the range of 10-30 g/m$^2$ or in the range of 10-50 g/m$^2$. Optionally, the nonwoven can have a thickness of 50 to 250 microns, optionally approximately 130 microns.

In one optional embodiment, the absorbent material can be or include code II silica or aluminum silica gel with an average particle size of (or less than) 1 mm Optionally, the absorbent material can include one or more of a gel, a mineral (e.g., salt) and a cross link (e.g., bifunctional water-soluble crosslinker for carboxyl, amine and hydroxyl functional polymers, or ethylene glycol diglycidyl ether (EGDGE)). Optionally, the absorbent retains any, all, or most liquid exuded from the liquid-exuding product. In one embodiment, the absorbent can be a superabsorbent, which in a dehydrated state occupies very little or low volume and creates very little or less bulk.

Optionally, the absorbent is formed of or includes liquid absorbing particles, preferably larger than 100 μm. Optionally, the absorbent includes or is comprised of silica either natural or synthetic with varying cations.

Optionally, the absorbent can be a composition of matter (e.g., powder mixture) or a single article (e.g., sponge), for example.

Absorbent materials usable in conjunction with methods according to the disclosed concepts include food safe absorbent materials having an absorbent composition of matter suitable for use with food products. The absorbent composition of matter has an absorbency, the absorbency being defined by weight of liquid absorbed/weight of the absorbent composition of matter.

In any embodiment, the absorbent can include a cross-linked or a non-cross-linked gel-forming polymer. Such gel-forming polymer can be water soluble or insoluble. In any embodiment, the absorbent can further include at least one of the following: 1) at least one mineral composition, 2) at least one soluble salt having at least one trivalent cation, and/or 3) an inorganic buffer.

In an optional embodiment, the absorbent can include at least one non-crosslinked gel-forming water soluble polymer having a first absorbency, the first absorbency being defined by weight of liquid absorbed/weight of the at least one non-crosslinked gel forming polymer, the at least one non-crosslinked gel forming polymer being food safe, the absorbent composition of matter being compatible with food products such that the absorbent composition of matter is food safe when in direct contact with the food products.

In an optional embodiment, the absorbent can include the following: (i) at least one non-crosslinked gel-forming water soluble polymer having a first absorbency, the first absorbency being defined by weight of liquid absorbed/weight of the at least one non-crosslinked gel forming polymer, the at least one non-crosslinked gel forming polymer being food safe; and (ii) at least one mineral composition having a second absorbency, the second absorbency being defined by weight of liquid absorbed/weight of the at least one mineral composition, the at least one mineral composition being food safe, the absorbency of the absorbent material exceeding the first absorbency and the second absorbency, the absorbent material being compatible with food products such that the absorbent composition of matter is food safe when in direct contact with the food products. It should, however, be understood that alternative absorbents such as those described above may be used in accordance with the disclosed concept.

In an optional embodiment, the absorbent can include the following: (i) at least one non-crosslinked gel-forming water soluble polymer having a first absorbency, the first absorbency being defined by weight of liquid absorbed/weight of the at least one non-crosslinked gel forming polymer, the at least one non-crosslinked gel forming polymer being food safe; and (ii) at least one soluble salt having at least one trivalent cation, the at least one soluble salt having at least one trivalent cation being food safe, the absorbency of the absorbent material exceeding the first absorbency and the second absorbency, the absorbent material being compatible with food products such that the absorbent composition of matter is food safe when in direct contact with the food products. It should, however, be understood that alternative absorbent materials such as those described above may be used in accordance with the disclosed concept.

In an optional embodiment, the absorbent can include the following: (i) at least one non-crosslinked gel-forming water soluble polymer having a first absorbency, the first absorbency being defined by weight of liquid absorbed/weight of the at least one non-crosslinked gel forming polymer, the at least one non-crosslinked gel forming polymer being food safe; (ii) at least one mineral composition having a second absorbency, the second absorbency being defined by weight of liquid absorbed/weight of the at least one mineral composition, the at least one mineral composition being food safe; and/or (iii) at least one soluble salt having at least one trivalent cation, the at least one soluble salt having at least one trivalent cation being food safe, the absorbency of the absorbent composition of matter exceeding a sum of the first absorbency and the second absorbency, the absorbent material being compatible with food products such that the absorbent composition of matter is food safe when in direct contact with the food products. It should, however, be understood that alternative absorbent materials such as those described above may be used in accordance with the disclosed concept. Any of the embodiments of the absorbent composition of matter described above may optionally comprise an inorganic or organic buffer.

Optionally, the absorbent can contain from about 10% to 90% by weight, preferably from about 50% to about 80% by weight, and most preferably from about 70% to 75% by weight polymer. The non-crosslinked gel forming polymer can be a cellulose derivative such as carboxymethylcellulose (CMC) and salts thereof, hydroxyethylcellulose, methylcellulose, hydroxypropylmethylcellulose, gelatinized starches, gelatin, dextrose, and other similar components, and may be a mixture of the above. Certain types and grades of CMC are approved for use with food items and are preferred when the absorbent is to be so used. The preferred polymer is a CMC, most preferably sodium salt of CMC having a degree of substitution of about 0.7 to 0.9. The degree of substitution refers to the proportion of hydroxyl groups in the cellulose molecule that have their hydrogen substituted by a carboxymethyl group. The viscosity of a 1% solution of CMC at 25° C., read on a Brookfield viscometer, should be in the range of about 2500 to 12,000 mPa. The CMC used in the Examples following was obtained from Hercules, Inc. of Wilmington, DE (under the trade name B315) or from AKZO Nobel of Stratford, Conn. (under the trade name AF3085).

Optionally, a clay ingredient of the absorbent can be of any variety of materials and is preferably attapulgite, montmorillonite (including bentonite clays such as hectorite), sericite, kaolin, diatomaceous earth, silica, and other similar materials, and mixtures thereof. Preferably, bentonite is used. Bentonite is a type of montmorillonite and is principally a colloidal hydrated aluminum silicate and contains varying quantities of iron, alkali, and alkaline earths. The preferred type of bentonite is hectorite which is mined from specific areas, principally in Nevada. Bentonite used in the Examples following was obtained from American Colloid Company of Arlington Heights, Ill. under the trade name BENTONITE AE-H.

Diatomaceous earth is formed from the fossilized remains of diatoms, which are structured somewhat like honeycomb or sponge. Diatomaceous earth absorbs fluids without swelling by accumulating the fluids in the interstices of the structure. Diatomaceous earth was obtained from the American Colloid Company.

In one optional embodiment, clay and diatomaceous earth are present in an amount from about 10-90% by weight, optionally about 20-30% by weight, however, some applications, such as when the absorbent material is to be used to absorb solutions having a high alkalinity, i.e., marinades for poultry, can incorporate up to about 50% diatomaceous earth. The diatomaceous earth can replace nearly all of the clay, with up to about 2% by weight remaining clay.

Optionally, a trivalent cation is provided in a soluble salt, such as derived from aluminum sulfate, potassium aluminum sulfate, and other soluble salts of metal ions such as aluminum, chromium, and the like. Optionally, the trivalent cation is present at about 1% to 20%, most preferably at about 1% to 8%.

An inorganic buffer is one such as sodium carbonate (soda ash), sodium hexametaphosphate, sodium tripolyphosphate, and other similar materials. An organic buffer in the absorbent can be citric acid, monopotassium phosphate, or buffer mixture with a set pH range. If a buffer is used, it is optionally at about 0.6%, however, beneficial results have been achieved with amounts up to about 15% by weight.

The mixture of the non-crosslinked gel forming polymer, trivalent cation, and clay forms an absorbent material which, when hydrated, has an improved gel strength over the non-crosslinked gel forming polymer alone. Further, the gel exhibits minimal syneresis, which is exudation of the liquid component of a gel.

In addition, the combined ingredients form an absorbent material which has an absorbent capacity which exceeds the total absorbent capacity of the ingredients individually. While not limited by this theory, it appears that the trivalent cation provides a cross-linking effect on the CMC once in solution, and that the clay swells to absorb and stabilize the gels. Further, as shown by Example D of Table 1 below, it appears that, in some cases at least, it is not necessary to add trivalent cation. It is thought that perhaps a sufficient amount of trivalent cation is present in the bentonite and diatomaceous earth to provide the crosslinking effect.

The gels formed by the absorbent material of the invention are glass clear, firm gels which may have applications in other areas such as for cosmetic materials. Some embodiments of the disclosed concept are set forth in Table 1. As used in Table 1, absorption is defined as the increased weight achieved in an absorbent pad structure of the type described in U.S. Pat. No. 6,376,034, following placement of such pad in a tray-type container with 0.2% saline therein in such quantities as to not limit the access of fluid to the pad for up to 72-96 hours until no further increase of weight is apparent. The net absorption is the difference between the final weight of the pad and the dry starting weight, after deducting the net absorbency of the base pad material other than the absorbent blend i.e. the fabric component. This is converted to a gram/gram number by dividing the net absorption by the total weight of absorbent blend incorporated in the pad. Such a procedure is accurate for comparative purposes when the pad structure used is the same for all the tested blends.

TABLE 1

EXAMPLES OF PREFERRED EMBODIMENTS

| | | | Absorbency-gm/gm | | | |
|---|---|---|---|---|---|---|
| | Ingredient | weight % | Individual Ingredient | Expected from Summation | Actual | Actual/Expected |
| A | CMC-B315 | 71.3 | 35 | 26.59 | 43.12 | 162.17% |
| | Potassium Aluminum Sulfate | 6.19 | 0 | | | |
| | Bentonite (i.e., Hectorite) | 22.5 | 7 | | | |
| B | CMC-AF3085 | 71.2 | 35 | 27.5 | 53.94 | 196.15% |
| | Potassium Aluminum Sulfate | 6.32 | 0 | | | |
| | Diatomaceous Earth | 20.2 | 12 | | | |
| | Bentonite | 2.25 | 7 | | | |
| C | CMC-AF3085 | 74.4 | 35 | 28.75 | 65.37 | 227.37% |
| | Potassium Aluminum Sulfate | 1.47 | 0 | | | |
| | Diatomaceous Earth | 21.2 | 12 | | | |
| | Bentonite | 2.35 | 7 | | | |
| | Soda Ash (sodium carbonate) | 0.58 | 0 | | | |
| D | CMC-AF3085 | 70 | 35 | 26.12 | 56.74 | 217.23% |
| | Diamotaceous Earth | 27 | 12 | | | |
| | Bentonite | 3 | 7 | | | |
| E | granulated CMC-AF3085 | 70.7 | 35 | 26.37 | 49.17 | 186.46% |
| | Potassium Aluminum Sulfate | 6.14 | 0 | | | |
| | Bentonite | 23.2 | 7 | | | |
| F | CMC-AF3085 | 70.8 | 35 | | | |
| | Potassium Aluminum Sulfate | 6.89 | 0 | 27.35 | 51.79 | 189.36% |
| | Bentonite | 2.23 | 7 | | | |
| | Diatomaceous Earth | 20.1 | 12 | | | |
| G | CMC-AF3085 | 54.0 | 35 | 24.67 | 48.97 | 198.5% |
| | Bentonite | 40.0 | 7 | | | |
| | Alginate | 5.94 | 50 | | | |
| | Calcium Chloride | 0.06 | 0 | | | |
| H | CMC-AF3085 | 75.3 | 35 | 27.98 | 62.51 | 223.4% |
| | Bentonite | 23.2 | 7 | | | |

TABLE 1-continued

EXAMPLES OF PREFERRED EMBODIMENTS

| | Ingredient | weight % | Absorbency-gm/gm Individual Ingredient | Expected from Summation | Actual | Actual/Expected |
|---|---|---|---|---|---|---|
| | Potassium Aluminum Sulfate | 1.5 | 0 | | | |
| I | CMC-AF3085 | 73.5 | 35 | 27.35 | 64.42 | 235.5% |
| | Bentonite | 23.2 | 7 | | | |
| | Potassium Aluminum Sulfate | 3.3 | 0 | | | |
| J | CMC-B315 | 31.82 | 35 | 18.46 | 32.85 | 177.9% |
| | Diatomaceous Earth | 54.96 | 12 | | | |
| | Bentonite | 10.44 | 7 | | | |
| | Potassium Aluminum Sulfate | 2.78 | 0 | | | |

It is apparent from Table 1 that a significant synergistic effect has been achieved in the absorption behavior of these blends, resulting in dramatic improvement in absorption capacity of the blends compared to the individual components. As the non-CMC ingredients are of much lower cost than CMC itself, the blends achieve major reductions in cost per unit weight of absorption.

The absorbent is not particularly limited to any material class. However, in certain uses, the absorbent needs to be food safe, possesses a desirable absorbency, and exhibits a minimum syneresis. For example, the absorbent material may include one or more of the following: tissue paper, cotton, sponge, fluff pulp, polysaccharide, polyacrylate, psillium fiber, guar gum, locust bean gum, gellan gum, alginic acid, xyloglucan, pectin, chitosan, poly(DL-lactic acid), poly(DL-lactide-co-glycolide), poly-caprolactone, polyacrylamide copolymer, ethylene maleic anhydride copolymer, cross-linked carboxymethylcellulose, polyvinyl alcohol copolymers, cross-linked polyethylene oxide, starch grafted copolymer of polyacrylonitrile, and a cross-linked or non-cross-linked gel-forming polymer.

Figure 4:
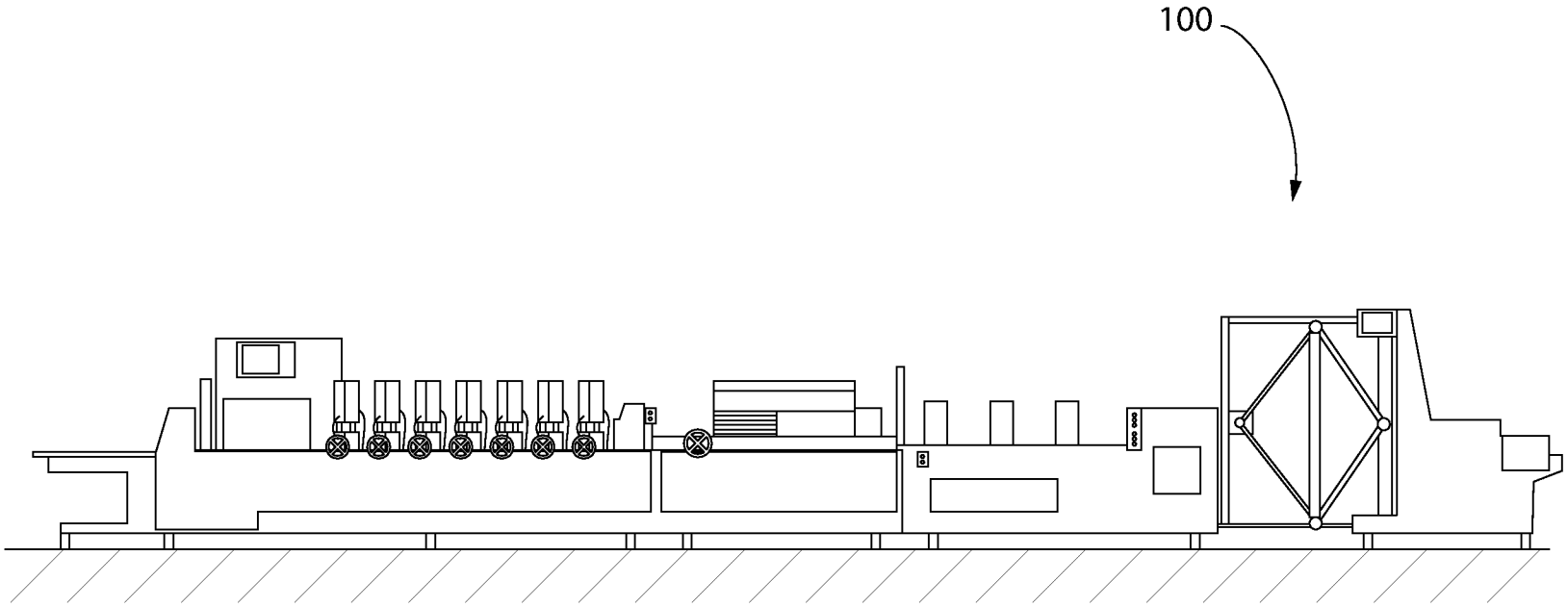
FIG. 4 (PRIOR ART)
FIG. 4 is gusseted bottom pouch-making machine according to the prior art.
Figure 5:
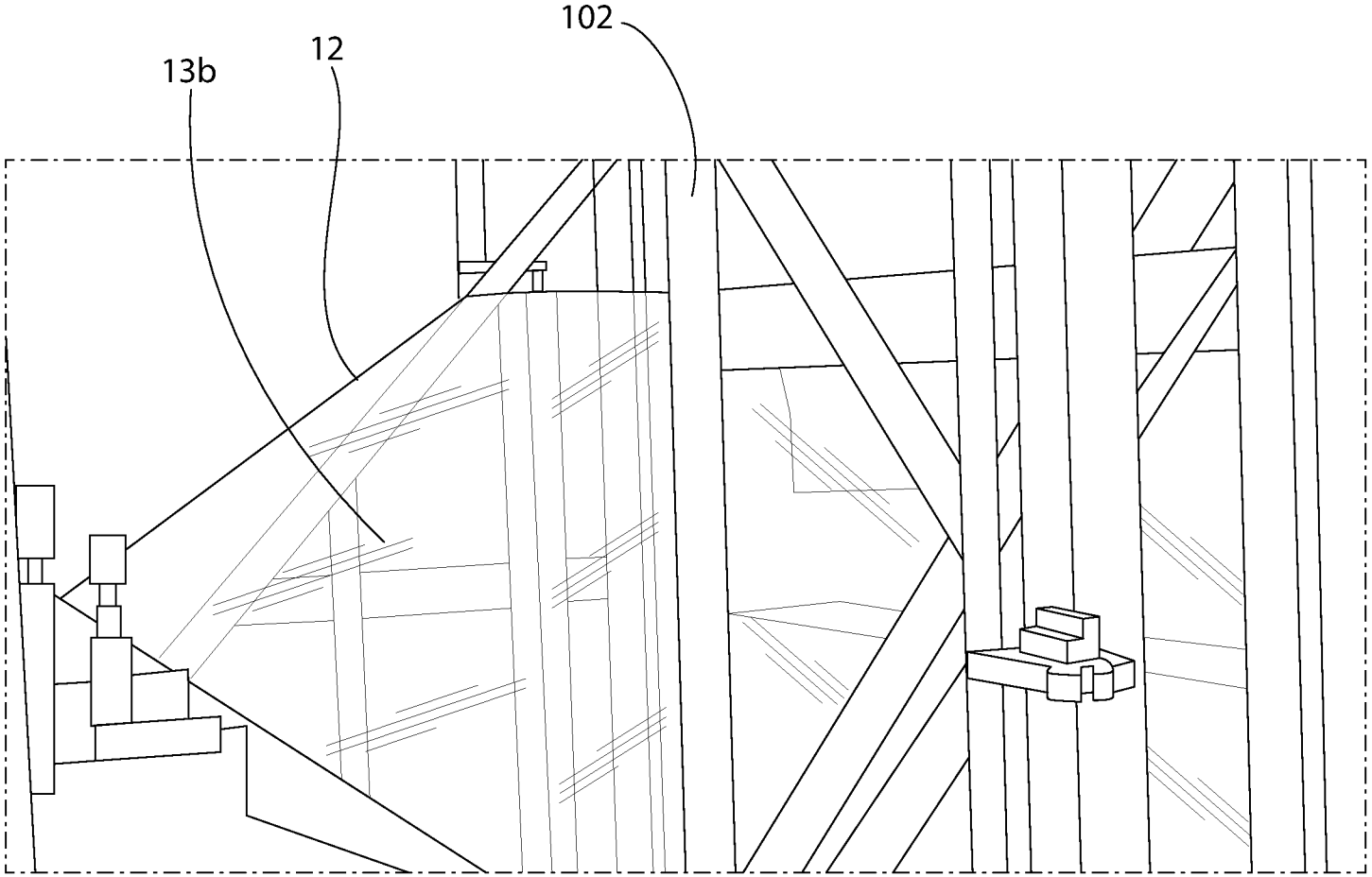
FIG. 5 is a view of a portion of a gusseted bottom pouch-making machine according to one embodiment of the presently disclosed technology.

In one aspect, the pouch 10 of the presently disclosed technology can be formed by, on, in, or with a gusseted bottom pouch-making machine. FIG. 4 shows a conventional gusseted bottom pouch-making machine, generally designated 100. As shown in FIG. 5, the active member 16 can be deposited or attached to the film 12 near or adjacent to a fold point 102 in the conventional gusseted bottom pouch-making machine 100. For example, the absorbent 16 can be attached to the film 12 either to the right or the left of the fold point 102 shown in FIG. 5. More particularly, the absorbent 16 can be attached or secured to the second or opposing side 13*b* (e.g., top and/or interior side) of the film 12. The fold point 102 can be a bar or rod that the film 12 travels past and/or around. The fold point 102 can optionally extend along a single vertical axis. The step of depositing or attaching the active member 16 to the film 12 can be completed by a separate machine, or an add-on or extension to the gusseted bottom pouch-making machine.

Figure 6:
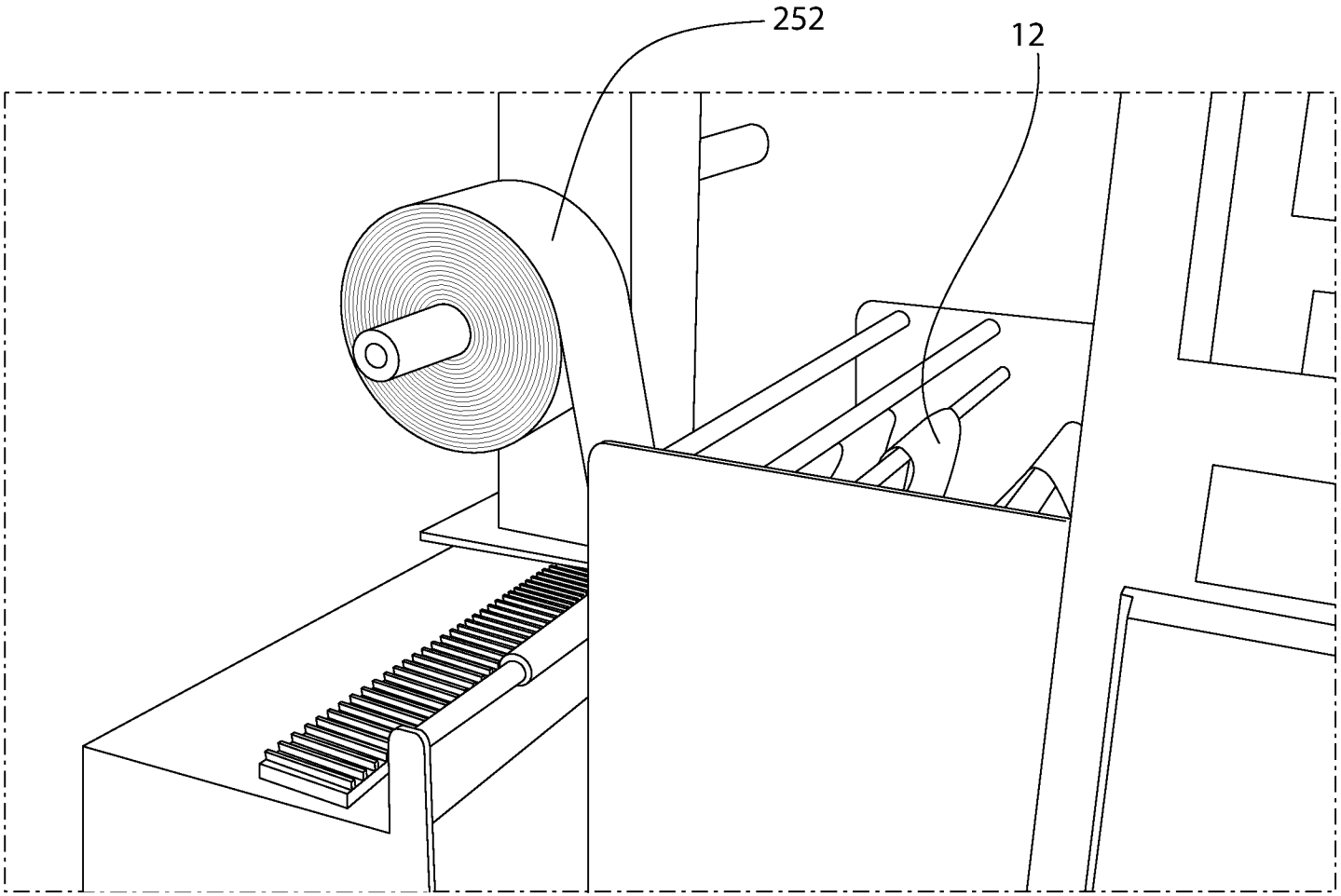
FIG. 6 is a portion of a flat bottom pouch-making machine according to one embodiment of the presently disclosed technology.
Figure 7:
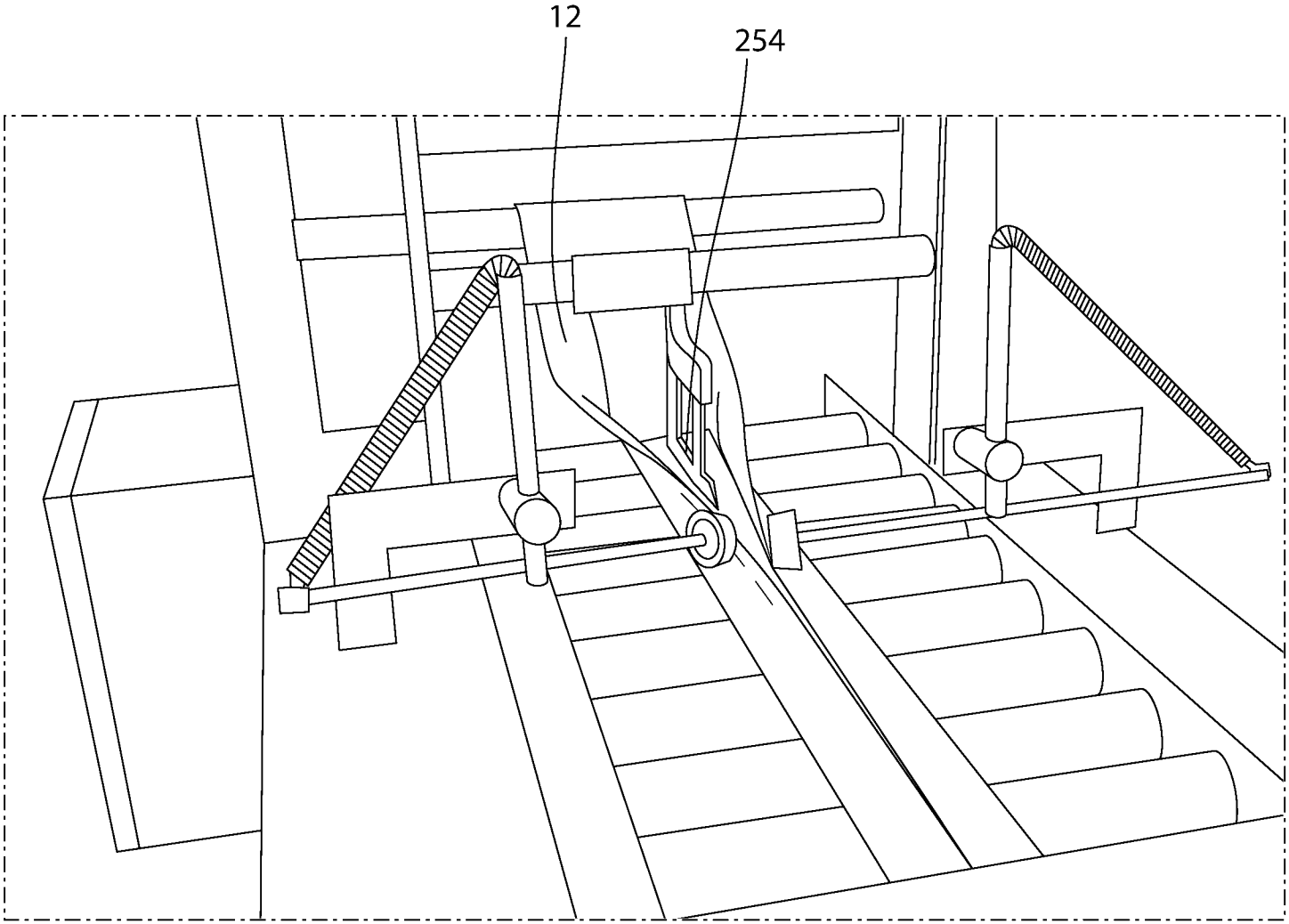
FIG. 7 is another portion of a flat bottom pouch-making machine according to one embodiment of the presently disclosed technology.

In another aspect, the pouch 10 of the presently disclosed technology can be formed by, on, or with a flat bottom pouch-making machine. As shown in FIG. 6, the beginning or an early stage of a flat bottom pouch-making machine includes unwinding or unrolling a roll 252 of the film 12. The film 12 can be fed over or around separators or rods to position the film 12 in the desired orientation (e.g., flat) to eventually receive the active member 16 and be formed into a pouch. As shown in FIG. 7, a downstream stage of a flat bottom pouch-making machine can include a folding plow 254, which is designed to manipulate the film 12 into a particular or desired configuration.

Figure 8:
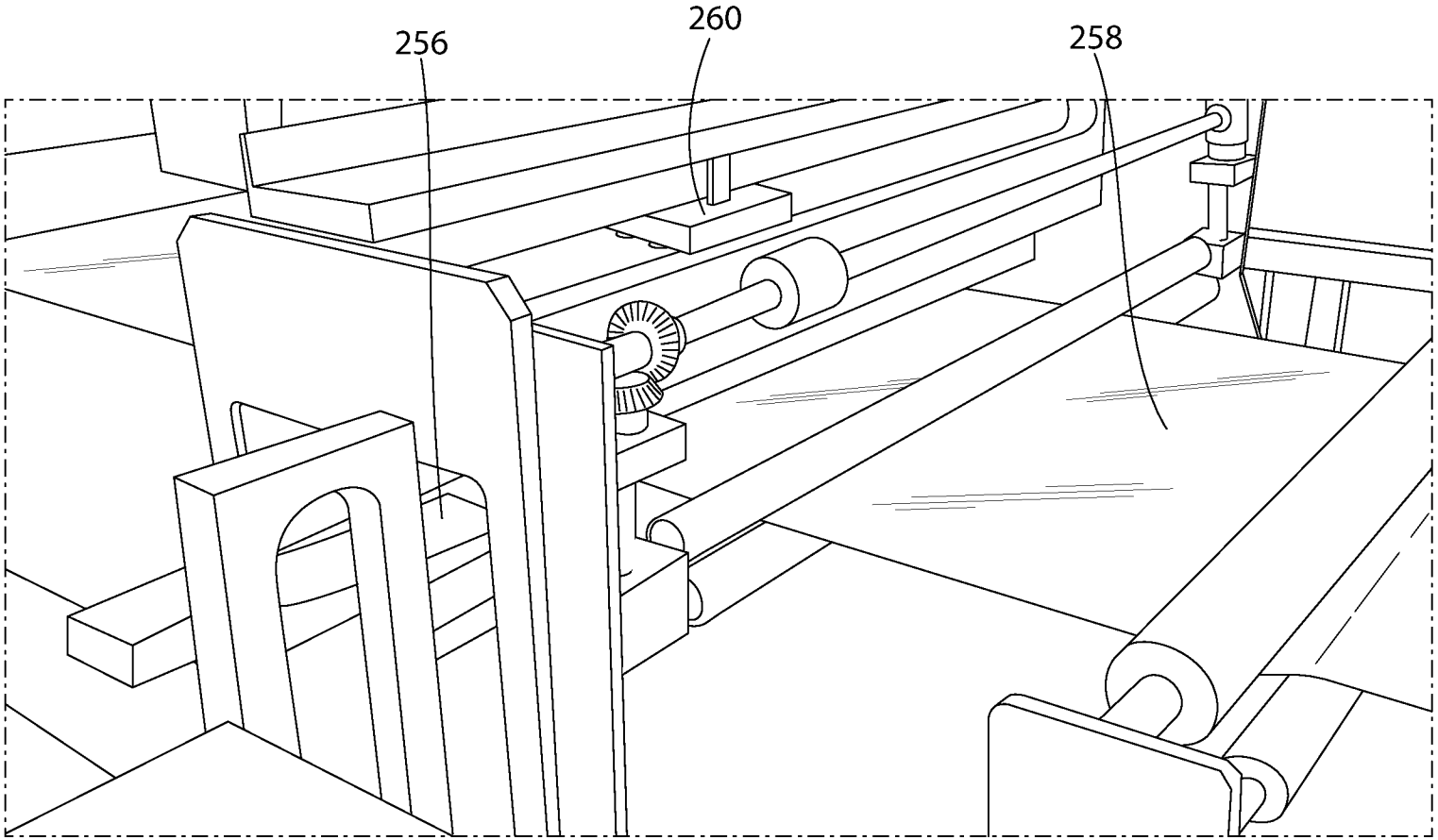
FIG. 8 is another portion of a flat bottom pouch-making machine according to one embodiment of the presently disclosed technology.

According to one aspect of the presently disclosed technology, the active member 16 (e.g., in a premade or final form) can be deposited or attached to the film 12 after or downstream of (i.e., after) the roll 252 and before or upstream of (i.e., before) the folding plow 254. After the active member 16 is attached or adhered to the film 12, optionally the active member 16 eventually forms or is part of the bottom surface of the pouch 10. In particular, as shown in FIG. 8, the piece 256 of the film 12 that eventually becomes the bottom of the pouch 10 can optionally be moved transversely into a path of one or more other pieces 258 of the film 12, and eventually all pieces are attached together to form the finalized pouch 10. A movable head 260 can grab, lift, and/or cut the piece 256 of the film 12 and move it into place to be attached or adhered to the one or more other pieces 258 of the film. 12.

In either manufacturing method described above (e.g., FIGS. 5-7), absorbent material, optionally in the form of absorbent powder or granules, can be applied to or deposited on a predetermined location of the film 12. In one optional embodiment, a roll can be employed to deposit the absorbent material to the film 12. Next, a nonwoven item can be placed on top of the absorbent material, thereby sandwiching the absorbent material between the nonwoven item and the film 12. Optionally, the nonwoven item can form a pocket or include one or more pockets to container the absorbent material. The amount of absorbent can be modified depending upon the particular application and customer needs. Next, the nonwoven item can be fixed to the film 12, such as through heat staking, thermoform staking, welding, and/or by a food-safe adhesive.

In an optional embodiment, an active member (e.g., an absorbent) is attached to film at one stage of a vertical form fill and seal machine or a horizontal form fill and seal machine. For example, a premade active member, optionally with absorbent material inside or contained by a nonwoven component and the film), can be attached to a portion of a roll of film 12 as the film 12 is formed into a pouch or container by a vertical form fill and seal machine (VFFS) or a horizontal form fill and seal machine (HFFS). In a different example, the active member can be formed or constructed (e.g., enclosing or attaching absorbent material in a nonwoven component and/or the film) during formation of the pouch or counter instead of the active member being premade.

The following exemplary embodiments further describe optional aspects of the presently disclosed technology and are part of this Detailed Description. These exemplary embodiments are set forth in a format substantially akin to claims (each set including a numerical designation followed by a letter (e.g., "A," "B," etc.), although they are not technically claims of the present application. The following exemplary embodiments refer to each other in dependent relationships as "embodiments" instead of "claims."

1A. A stand-up pouch having an absorbent pad heat staked to an interior surface of a bottom of the pouch.

2A. The pouch of embodiment 1A, wherein the absorbent is formed of a food-safe material.

3A. The pouch of embodiment 1A or 2A, further comprising foodstuff located inside the pouch.

4A. The pouch of embodiment 3A, wherein the foodstuff includes frozen fresh foodstuff.

5A. The pouch of embodiment 4A, wherein the frozen fresh foodstuff is frozen fresh shrimp or other frozen fresh seafood or frozen fresh fruit or frozen fresh vegetables.

1B. A package for containing liquid-exuding product, the package being formed of a single sheet of film that is folded at certain locations to form a stand-up pouch, the package comprising:

means for attaching an absorbent to a portion of the single sheet of film such that the absorbent is located on an interior surface of a bottom of the folded package.

2B. The package of embodiment 1B, wherein the means for attaching is heat staking.

3B. The package of embodiment 1B, wherein the means for attaching is adhesive.

4B. The package of embodiment 1B, wherein the means for attaching is thermoforming.

1C. A stand-up pouch comprising an absorbent integrated into a bottom of the pouch.

2C. The stand-up pouch of embodiment 1C, wherein the absorbent is in the form of a pad.

3C. The stand-up pouch of embodiment 1C or 2C, further comprising frozen fresh foodstuff inside the pouch.

While the presently disclosed technology has been described in detail and with reference to specific examples thereof, it will be apparent to one skilled in the art that various changes and modifications can be made therein without departing from the spirit and scope thereof. It is understood, therefore, that the presently disclosed technology is not limited to the particular embodiments disclosed, but it is intended to cover modifications within the spirit and scope of the present presently disclosed technology as defined by the appended claims.

What is claimed is:

1. A method of forming a package configured to contain product, the method comprising steps:

a) heat staking or thermoforming only a single active member to a portion of only one single sheet of film that has been unrolled such that the single active member does not occupy an entire interior surface of the single sheet of film, the active member including an absorbent material; and b) folding the single sheet of film and sealing portions of the film together following the completion of step a) such that the film forms a package having an opening leading to a cavity configured to contain product and the active member is located on an interior surface of the package, wherein the single active member is an entrained polymer including the absorbent material in the form of an active agent, and wherein the active agent is desiccant.

2. The method of claim 1, wherein the active member has a flat top surface opposite a portion of the active member that contacts the single sheet of film.

3. The method of claim 2, further comprising the steps of filling the package with product and then sealing the opening, thereby rendering the package completely sealed.

* * * * *